United States Patent [19]

De Luca

[11] Patent Number: 5,033,620

[45] Date of Patent: Jul. 23, 1991

[54] METHOD OF AUTOMATICALLY ATTACHING THE ENDS OF FAN-FOLDED WEB MATERIAL

[75] Inventor: Raymond F. De Luca, Stamford, Conn.

[73] Assignee: Georgia-Pacific Corporation, Atlanta, Ga.

[21] Appl. No.: 340,139

[22] Filed: Apr. 18, 1989

[51] Int. Cl.[5] ..... B65D 85/67

[52] U.S. Cl. ..... 206/494; 206/449; 206/460

[58] Field of Search ..... 206/449, 460, 494, 451, 206/452

[56] References Cited

U.S. PATENT DOCUMENTS

| | | | |
|---|---|---|---|
| 3,836,045 | 9/1974 | Duhy et al. | 206/494 |
| 3,915,302 | 10/1975 | Farrelly et al. | 206/460 |
| 3,987,901 | 10/1976 | Dullinger | 206/460 |
| 4,076,122 | 2/1978 | Hall | 206/460 |
| 4,350,246 | 9/1982 | Mayer | 206/494 |
| 4,674,634 | 6/1987 | Wilson | 206/494 |

*Primary Examiner*—Joseph M. Moy

*Attorney, Agent, or Firm*—Banner, Birch, McKie & Beckett

[57] ABSTRACT

A method for automatically connecting together packages of fan-folded towelling in a dispenser. A pattern of adhesive tape or glue is applied to the lower-most surface of an upper package and a corresponding pattern of adhesive tape or glue is applied to the upper-most surface of a lower package. When the two packages are placed on top of each other, the adhesive patterns adhere to each other, thereby connecting both packages together. Thus, when the lower package is exhausted, the upper package is automatically drawn through the dispenser opening and is available for the user.

4 Claims, 2 Drawing Sheets

METHOD OF AUTOMATICALLY ATTACHING THE ENDS OF FAN-FOLDED WEB MATERIAL

BACKGROUND OF THE INVENTION

The present invention generally relates to the field of paper toweling and paper towel dispensers. More particularly, the invention is directed to a method of automatically attaching the ends of fan-folded paper towel stacks in a dispenser.

Paper towel dispensers are well known in the art as a convenient and sanitary way of providing a supply of towels in washroom and other facilities. By using a fan-folded stack of individual towel sheets, a number of problem encountered with a rolled web of toweling is avoided. For example, no inertial force must be overcome to start rotation of a roll and no arresting force is necessary to stop the rotation of the roll once it has begun. Thus, towels arranged in a fan-folded stack for dispensing does not have to have great physical strength which usually is inconsistent with the desired characteristics of softness, bulky feel and absorbency. Accordingly, such toweling does not require elaborate transfer mechanisms to facilitate dispensing.

Fan-folded towel dispensers usually are designed to receive a stack of toweling 1 as generally shown in FIG. 1. The leading edge of the bottom-most towel 2 in the stack is treaded through a dispensing opening within the dispenser case 3. Some fan-folded towel dispensers are designed with a simple feed wheel mechanism as illustrated by feed wheel 4 in FIG. 1 while other dispensers merely have an elongated opening at the bottom of the dispenser case. When the towel is grasped and pulled from the dispenser by a user, the fan-folded arrangement of the towel stack causes the leading edge of the next towel to be automatically drawn through the dispensing open for the next user. When the stack of towels is exhausted, a fresh stack is installed in the dispenser with the leading edge of its lower-most towel manually threaded through the dispensing opening.

The use of fan-folded stacks of toweling in a conventional dispenser is in most cases satisfactory except when the supply of towels is exhausted or the leading edge of the lower-most towel has not been properly threaded through the dispensing opening. The design of most dispensers makes it difficult to thread the leading edge of the lower-most towel through the dispenser opening without access to the inside of the dispenser.

Towel dispensers usually are designed with a lock which can only be opened by an attendant. While locking the dispenser serves a useful purpose in preventing pilferage and waste, the disadvantage is that the dispenser cannot be readily opened to replenish the towel supply or to properly thread the leading edge of the lower-most towel through the dispensing opening. Accordingly, toweling is not always available to the user when needed. Thus, the user becomes frustrated, especially since the most users only turn to the dispenser when in immediate need of a towel, e.g., to dry their hands. Placing free-standing stacks of toweling outside of the dispenser also is not a practical solution because to do so also invites pilferage and waste as well as leads to litter.

Frequent servicing of conventional fan-folded towel dispensers also is not a good solution due to the high labor cost involved. Servicing of the dispenser also involves two conflicting goals. The first is that the dispenser should be adequately stacked so that its supply of towels is not exhausted before the next service call. The second goal is to avoid waste of toweling. The first goal can be realized at the expense of the second goal by replacing partially used stacks with a fresh stack of towels. Discarding partially used stacks is not an economical alternative.

SUMMARY OF THE INVENTION

Accordingly, the overall object of the present invention is to provide a method of preventing the supply of fan-folded toweling in a dispenser from premature exhaustion.

It is a specific object of the present invention to provide a method of attaching the end of one stack of fan-folded toweling to the end of another stack of toweling.

It is a further object of the present invention to provide an automatic and highly reliable method of attaching the bottom surface of the lower-most towel of a fan-folded stack to the top surface of the upper-most towel of another fan-folded stack within a towel dispenser.

It is another object of the present invention to realize the above mentioned objects in a manner which is economical in cost and easy to implement.

The above objects are realized in accordance with present invention by applying a pattern of adhesive tape or glue to the lower-most surface of the upper stack and a corresponding pattern of adhesive tape or glue to the upper-most surface of the lower stack. When the two stacks are placed on top of each other, the adhesive patterns adhere to each other, thereby connecting both stacks together. Thus, when the lower-most stack is exhausted, the upper stack is automatically drawn through the dispenser opening and is available for the user. Applicant has found that joining stacks in this manner is economical, reliable and substantially overcomes the problems known in the prior art with respect to premature exhaustion of the supply of towels and mis-feeding of the leading edge of the stack through the towel dispenser opening.

DETAILED DESCRIPTION OF THE PREFERRED EMBODIMENT

Figure 1:
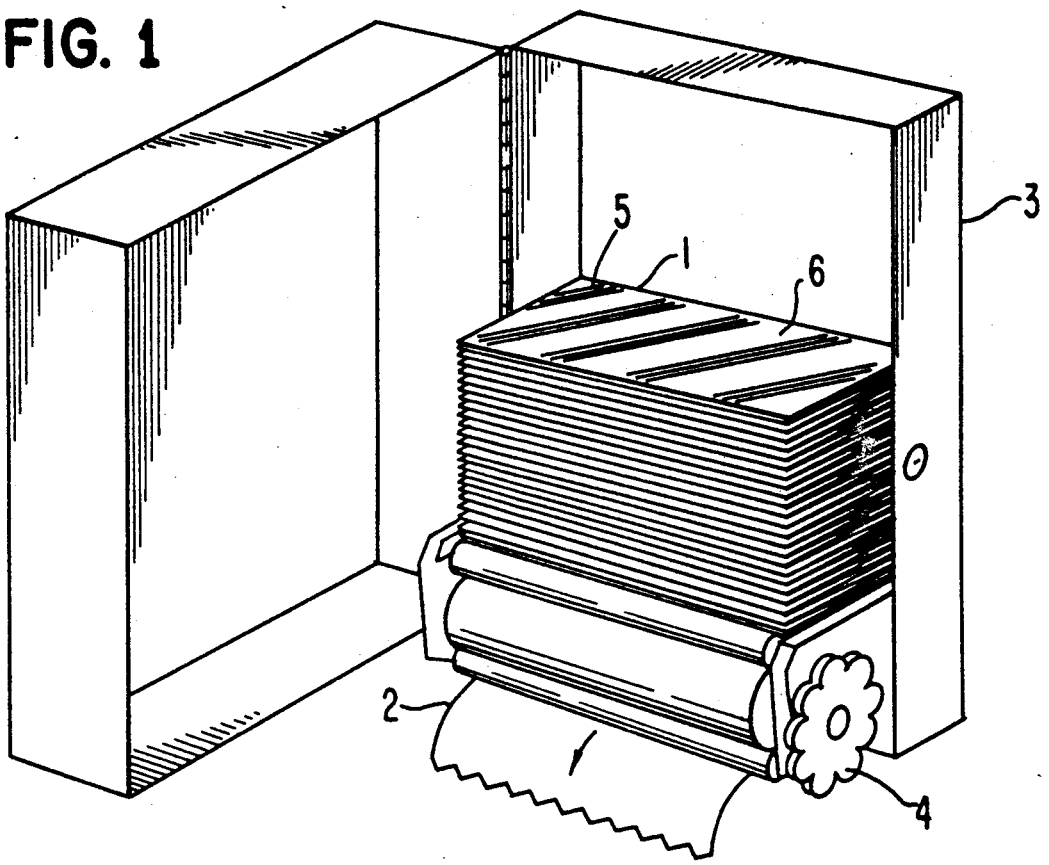
FIG. 1 is a perspective view of a fan-folded paper towel dispenser illustrating a stack of towels having a pattern of adhesive in accordance with the present invention.
Figure 2:
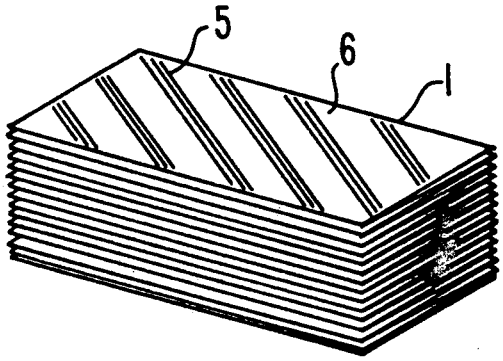
FIG. 2 is a perspective view of the stack of fan-folded paper toweling illustrated in FIG. 1.

The method of automatically connecting the ends of towel stacks will now be described in connection with the drawings. In the embodiment shown in FIGS. 1 and 2, a plurality of diagonally arranged strips 5 of adhesive tape are applied to the top surface 6 of the upper-most towel in stack 1. A similar arrangement of strips is applied to the bottom surface of the lower most towel in the stack. Thus, when one stack is set on top of another, the bottom sheet of the upper stack automatically adheres to the top sheet of the lower stack. Thus, the two stacks are attached together for continuous feeding through the dispenser.

Figure 3:
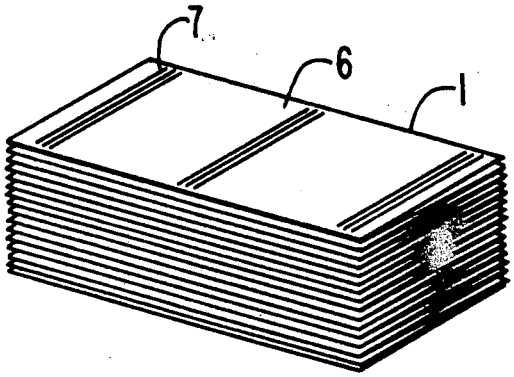
FIG. 3 is a perspective view of a stack of fan-folded paper toweling having an alternate pattern of adhesive in accordance with the present invention.
Figure 4:
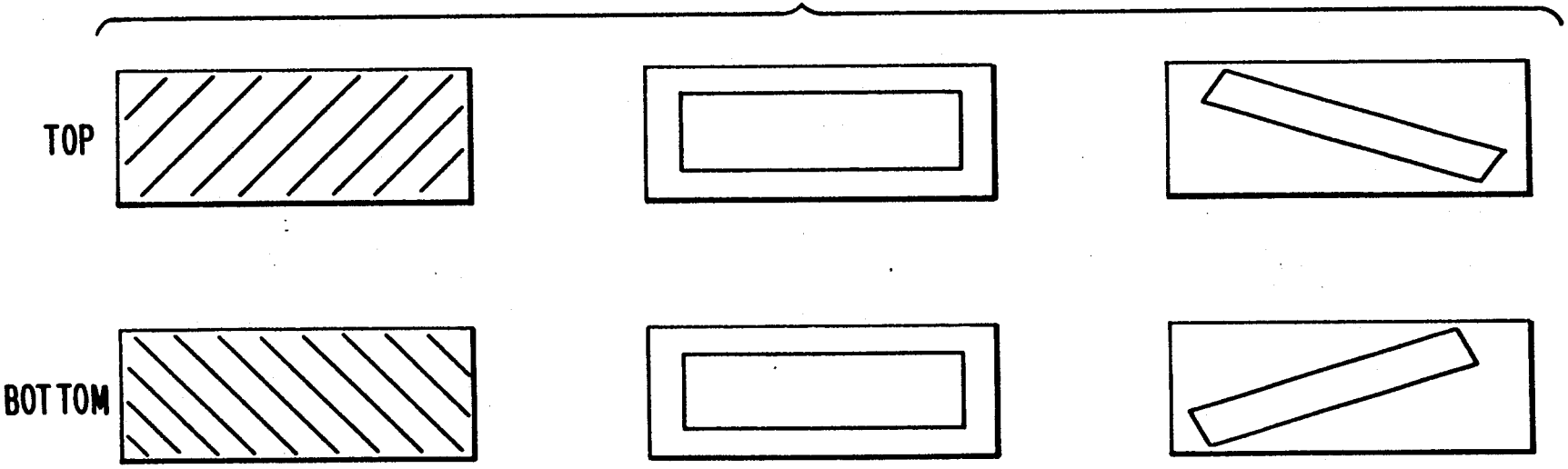
FIG. 4 illustrate other adhesive patterns which may be used in accordance with the present invention.

In the embodiment shown in FIG. 3, adhesive strips 7 on the top and bottom sheets of the stack are arranged parallel with respect to the edge of the towel. FIG. 4 illustrates other arrangements of adhesive strips on the top and bottom sheets of stack 1.

The adhesive strips may be formed from a number of adhesive materials which are known in the prior art. Ideally, the strips will be formed of material which adheres only to itself. Thus, the problem caused by the strips adhering to other objects, such as the wrapping used to bundle the stack of towels, is avoided. Where a self-sticking adhesive is not used, regular adhesive with a release liner may be used as well.

It should be obvious from the above-discussed embodiments that numerous other variations and modifications of the method of this invention are possible, and such will readily occur to those skilled in the art. Accordingly, the scope of this invention is not to be limited to the embodiments disclosed, but is to include any such embodiments as may be encompassed within the scope of the claims appended hereto.

I claim:

1. A package of fan-folded web material, said package having strips of an adhesive material on the exposed leading and trailing ends of said web material on opposite sides of said package, said adhesive material being formed of a substance which only sticks to itself, said adhesive being applied such that when on unwrapped package of said material is placed onto another unwrapped package, said adhesive strips on the two packages will touch and bond to each other.

2. The package of claim 1 wherein said adhesive material is arranged in a plurality of diagonal strips across said ends.

3. The package of claim 1 wherein said adhesive material is arranged in a plurality of parallel strips across said ends.

4. A package of fan-folded web material with spaced apart diagonal strips of an adhesive substance on the exposed leading and trailing ends of said web material on opposite sides of said package, said adhesive being formed of a substance which only sticks to itself, wherein said diagonal strips at each of the two sides of said package are arranged to run in the same direction so that when an unwrapped package is placed on top of another unwrapped package, said diagonal strips of adhesive will cross each other in checkerboard fashion, thereby adhering the leading end of the web material from one package to the trailing end of the web material of the other package.

* * * * *